US010304330B1

(12) United States Patent
Broz et al.

(10) Patent No.: US 10,304,330 B1
(45) Date of Patent: May 28, 2019

(54) PRIORITIZING TRAFFIC FLOW BASED ON VEHICLE-CAUSED ROAD DEGRADATION

(71) Applicant: International Business Machines Corporation, Armonk, NY (US)

(72) Inventors: Michal Broz, Cedar Park, TX (US); Henry E. Mikhail, Austin, TX (US); Cheryl L. King, Austin, TX (US); William J. Hoch, Liberty Hill, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/107,216

(22) Filed: Aug. 21, 2018

(51) Int. Cl.

| | |
|---|---|
| ***G08G 1/095*** | (2006.01) |
| ***G08G 1/01*** | (2006.01) |
| ***G08G 1/087*** | (2006.01) |
| ***G08G 1/015*** | (2006.01) |

(52) U.S. Cl.
CPC ..... *G08G 1/0145* (2013.01); *G08G 1/015* (2013.01); *G08G 1/087* (2013.01)

(58) Field of Classification Search
None
See application file for complete search history.

(56) References Cited

U.S. PATENT DOCUMENTS

| | | | | |
|---|---|---|---|---|
| 8,040,254 | B2 | 10/2011 | Delia et al. | |
| 8,731,807 | B2 * | 5/2014 | Friedlander | B60W 40/06 701/117 |
| 9,224,293 | B2 * | 12/2015 | Taylor | G08G 1/08 |
| 2017/0124863 | A1 * | 5/2017 | Dumazert | G08G 1/0112 |

OTHER PUBLICATIONS

Sunkari et al., "Reducing Truck Stops at High-Speed Isolated Traffic Signals," National Technical Information Service, 2000.

* cited by examiner

*Primary Examiner* — Julie B Lieu
(74) *Attorney, Agent, or Firm* — Steven M. Greenberg, Esq.; Shutts & Bowen LLP

(57) ABSTRACT

Embodiments of the present invention provide a method, system and computer program product for prioritizing traffic flow based on vehicle-caused road degradation. In an embodiment of the invention, a method for prioritizing traffic flow based on vehicle-caused road degradation includes detecting an approaching vehicle in a traffic control system disposed at an intersection governed by the traffic control system, classifying the approaching vehicle and correlating the classification of the approaching vehicle with a road degradation impact resulting from both a deceleration of the approaching vehicle and a subsequent acceleration of the approaching vehicle. The method further includes on condition that the road degradation impact exceeds a permissible impact, transmitting a message to the traffic control system to emit a visual signal permitting the approaching vehicle to pass through the intersection without stopping.

15 Claims, 2 Drawing Sheets

PRIORITIZING TRAFFIC FLOW BASED ON VEHICLE-CAUSED ROAD DEGRADATION

BACKGROUND OF THE INVENTION

Field of the Invention

The present invention is related to managing traffic flow, and more particularly to prioritizing traffic flow based on monitored traffic data.

Description of the Related Art

Traffic congestion is an ever-increasing problem due to the significant increase in the number of vehicles on the road. As such, it is essential that roadways are designed to optimize traffic flow. Modern optimization techniques attend to traffic optimization by applying artificial intelligence techniques to the coordination of sensors and traffic data to properly time of lights and respond to changes in the flow of traffic. In doing so, not only can the amount of time one spends in traffic decrease, but also smart traffic flow design reduces the overall impact of the pollution of vehicles. Traffic congestion, though, is not the only consequence of increased global vehicle ownership.

With the ever-increasing amount of traffic on the road, road degradation also become of significant concern. Road degradation refers to the deterioration of the quality and performance of a road, including its surface, and is caused by both environmental conditions and vehicles. Not only is road degradation costly to repair, road degradation is dangerous to both the occupants of the vehicle and the vehicle itself. Furthermore, in order to repair road degradation, the routing of traffic causes significant traffic congestion issues.

The axle weight of a vehicle significantly contributes to the problem of road degradation. Most notably, the acceleration and deceleration of a tractor trailer is known to increase the amount of road degradation caused by a vehicle. To wit, studies demonstrate an exponential increase in the amount of road degradation caused by vehicles of high axle weight, largely owing to the rapid acceleration and deceleration of such vehicles in traffic conditions and especially at intersections governed by traffic signals. In fact, the road degradation impact of a tractor-trailer has been shown to be dramatically higher than that of a number of automobiles of average weight whose combined weight equals the weight of a single tractor-trailer. As well, the impact of the axle weight of a tractor trailer, when combined with environmental conditions, as well as other vehicle design characteristics only compounds the amount of road degradation caused by the tractor trailer.

BRIEF SUMMARY OF THE INVENTION

Embodiments of the present invention address deficiencies of the art in respect to managing traffic flow and provide a novel and non-obvious method, system and computer program product for prioritizing traffic flow based on vehicle-caused road degradation. In an embodiment of the invention, a method for prioritizing traffic flow based on vehicle-caused road degradation includes detecting an approaching vehicle in a traffic control system disposed at an intersection governed by the traffic control system, classifying the approaching vehicle and correlating the classification of the approaching vehicle with a road degradation impact resulting from both a deceleration of the approaching vehicle and a subsequent acceleration of the approaching vehicle. The method further includes on condition that the road degradation impact exceeds a permissible impact, transmitting a message to the traffic control system to emit a visual signal permitting the approaching vehicle to pass through the intersection without stopping.

In one aspect of the embodiment, the road degradation impact is computed based upon both an environmental condition sensed for the intersection and also the classification. In another aspect of the embodiment, the road degradation impact is computed based upon both an environmental condition sensed for the intersection and also an axle weight determined for the approaching vehicle based upon the classification. In yet another aspect of the embodiment, the classification of the approaching vehicle is received wirelessly from a broadcasting data source disposed in the approaching vehicle. In even yet another aspect of the embodiment, the method further includes detecting a different vehicle proximate to the intersection and on a roadway that intersects a roadway upon which the approaching vehicle is traveling, classifying the different vehicle and correlating the classification of the different vehicle with a different road degradation impact. The method even further includes comparing the road degradation impact of the approaching vehicle to the different road degradation impact and on condition that the road degradation impact of the approaching vehicle exceeds the different road degradation impact, transmitting a message to the traffic control system to emit a visual signal permitting the approaching vehicle to pass through the intersection without stopping while concurrently emitting a visual signal preventing the different vehicle from passing through the intersection.

In another embodiment of the invention, a traffic control system configured for prioritizing traffic flow based on vehicle-caused road degradation has been claimed. The system includes a host computing system comprising memory and at least one processor, fixed storage coupled to the host computing system, one or more sensors in communication with the host computing system and a traffic flow prioritization module in communication with the host computing system. The traffic flow prioritization module includes computer program instructions executing in the memory of the host computing system that upon execution are adapted to perform: detecting through the one or more sensors an approaching vehicle in a traffic control system disposed at an intersection governed by the traffic control system, classifying the approaching vehicle and correlating the classification of the approaching vehicle with a road degradation impact resulting from both a deceleration of the approaching vehicle and a subsequent acceleration of the approaching value. The computer instructions are further adapted to perform: on condition that the road degradation impact exceeds a permissible impact, transmitting a message to the traffic control system to emit a visual signal permitting the approaching vehicle to pass through the intersection without stopping.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for prioritizing traffic flow based on vehicle-caused road degradation by dynamically adjusting a traffic light pattern based on traffic at, or approaching, a traffic intersection and the environmental conditions at the intersection. In accordance with an embodiment of the invention, a traffic light controller application controls at least one traffic light intersection and monitors traffic and environmental conditions through a plurality of sensors and data sources. The traffic light controller application detects the weight, speed and vehicle characteristics of an approaching vehicle or vehicles, as well as the environmental conditions, such as weather and road design, at the intersection, and determines the road degradation impact of the approaching vehicle or vehicles. If the road degradation impact of the approaching traffic exceeds a permissible impact, which may be determined based on the vehicles already stopped at the intersection or approaching the intersection from a different direction, the traffic light controller adjusts the traffic light at the intersection in order to limit the road degradation impact of the traffic.

Figure 1:
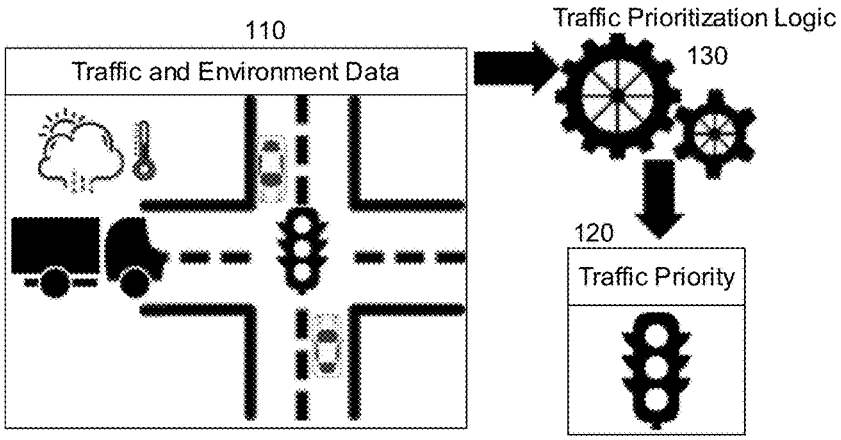
FIG. 1 is a pictorial illustration of a process for prioritizing traffic flow based on vehicle-caused road degradation.

In further illustration, FIG. 1 pictorially shows a process prioritizing traffic flow based on vehicle-caused road degradation. As shown in FIG. 1, the traffic and environment data and conditions are input into traffic prioritization logic 130 in order to determine whether to dynamically prioritize traffic based on estimated road degradation impact of detected oncoming traffic. Traffic prioritization logic 130 is in communication with a traffic pattern system 120, such as a traffic light or a grid of traffic lights. As well, traffic prioritization logic 130 is in communication with sensors and data sources that maintain updated information regarding traffic and environment data 110 within the traffic pattern system.

Traffic prioritization logic 130 through traffic and environment data 110 may determine the amount of vehicles within, entering and exiting an intersection or traffic pattern system through sensors and cameras utilizing computer vision techniques. Traffic prioritization logic 130 through traffic and environment data 110 may subsequently classify those vehicles in order to determine the road degradation impact and a permissible impact of those vehicles. Traffic prioritization logic 130 through traffic and environment data 110 may determine the weights of the vehicles by weighing the vehicles with weight sensors, such as a weigh-in motion sensors, transmitting the known weights from sensors or tags within the vehicles or estimating the weights with cameras utilizing computer vision techniques. Traffic prioritization logic 130 through traffic and environment data 110 may determine the distance from the intersection and the speed of the vehicles through sensors, such as speed sensors and distance sensors, or with cameras utilizing computer vision techniques. Traffic prioritization logic 130 through traffic and environment data 110 may determine the characteristics of the vehicles through cameras utilizing computer vision techniques and may determine the design of the vehicles, the number of axles, the type of tires, winter chains, etc. Traffic prioritization logic 130 may input the weight and vehicle characteristics to determine the axle weight of the respective vehicles.

As well, traffic prioritization logic 130 may determine the environmental conditions of the traffic and environment data 110 by communicating with other data sources or with weather sensors. The environmental conditions of traffic and environment data 110 may include the weather conditions, such as precipitation and temperature, the design of the road, such as the incline of the road, materials used, etc., and condition of the road. Using this information, the traffic prioritization logic 130 through traffic and environment data 110 may calculate the weight per axle of the vehicle or vehicles and input the relevant conditions in order to determine a permissible impact and a road degradation impact of the deceleration, stopping, and acceleration of the vehicle or vehicles. If the road degradation impact exceeds the permissible impact, which may be determined based on the road degradation impact of the rest of the traffic at, or approaching, the intersection, the environmental conditions at the intersection or as a pre-determined threshold value, the traffic prioritization logic 130 will dynamically adjust the traffic pattern to allow the vehicle or vehicles to pass through the intersection or intersections. Furthermore, the road degradation impact of vehicle or vehicles at or approaching the intersection may be compared to the road degradation impact of other vehicles at, or approaching, the intersection in order to determine the vehicles to pass through the intersection that will cause the lesser amount of road degradation.

Figure 2:
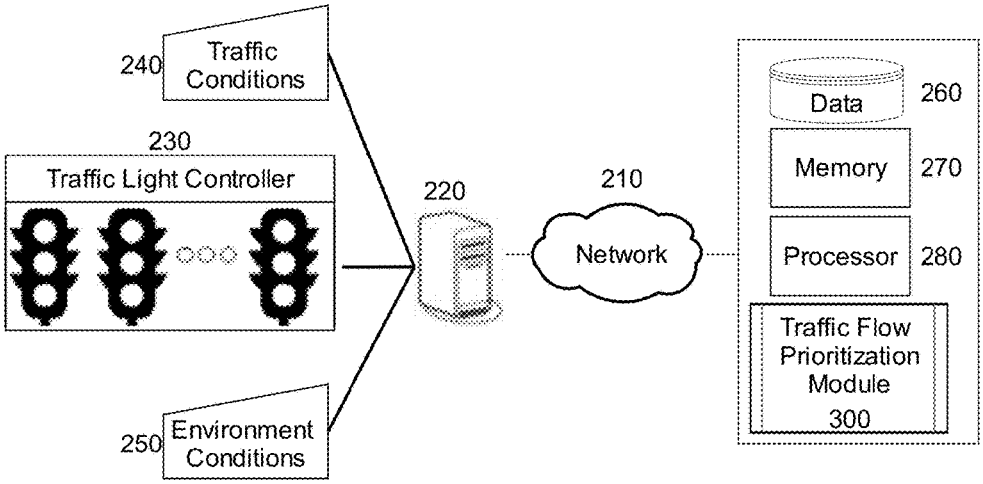
FIG. 2 is a schematic illustration of a traffic control system adapted for prioritizing traffic flow based on vehicle-caused road degradation; and, FIG. 3 is a flow chart illustrating a process for prioritizing traffic flow based on vehicle-caused road degradation.

The process shown in FIG. 1 may be implemented in a computer data processing system. In further illustration, FIG. 2 schematically shows a data processing system adapted for prioritizing traffic flow based on vehicle-caused road degradation. The system 200 communicates over a network 210 with a server 220 and the system includes at least one processor 280 and memory 270 and fixed storage 260 disposed within the system. The server or servers 220 communicate with a traffic pattern system, such as a traffic light controller 230 that controls a traffic light or grid of traffic lights. The server or servers 220 communicate with data sources and sensors that maintain updated traffic conditions 240 and environment conditions 250 within the traffic pattern system.

Traffic conditions 240 and environment conditions 250 may use a sensor or sensors throughout the traffic pattern system to determine the conditions of road degradation impacts and permissible impacts of traffic within the traffic pattern system. The environment conditions 250 may include the weather conditions, design of the road and condition of the road. The environment conditions 250 may be monitored through weather sensors, monitored through cameras equipped and computer vision functionality or input from outside data sources. The traffic conditions 240 may include the speed, weight and design of each of the vehicles, as well as the number of vehicles within, entering and exiting the traffic pattern system. The traffic conditions 240 may be monitored through sensors, such as weight sensors and speed sensors, transmitted from sensors or tags within the vehicle, monitored by cameras and computer vision techniques, or input from outside data sources.

Importantly, the traffic flow prioritization module 300 dynamically prioritizes traffic based on the estimated road degradation impact of vehicles traveling through a traffic pattern system controlled by the traffic light controller 230. Traffic flow prioritization module 300 inputs the traffic conditions 240 and environment conditions 250 to determine the road degradation impact of a vehicle or vehicles entering an intersection to determine whether the road degradation impact exceeds a permissible impact for traffic prioritization. If the road degradation impact exceeds the permissible impact, the traffic flow is prioritized by the traffic flow prioritization module 300 to allow the vehicle or vehicles to pass through the intersection without causing the vehicle or vehicles to decelerate.

Figure 3:
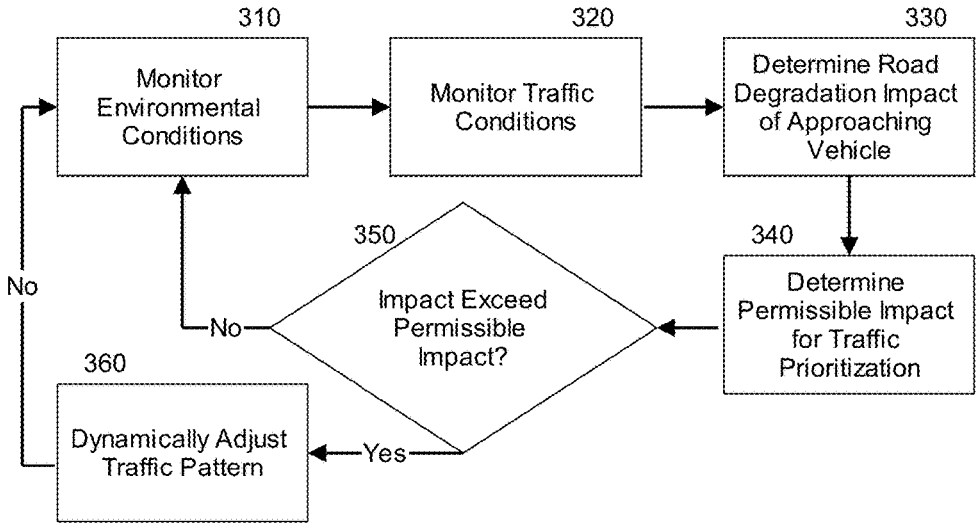

In even yet further illustration of the operation of the traffic flow prioritization module 300, FIG. 3 is a flow chart illustrating an exemplary process for prioritizing traffic flow based on vehicle-caused road degradation. Beginning in block 310, the environmental conditions, such as the weather conditions, design of the road and condition of the road, are monitored or input from other data sources. In block 320, the traffic conditions, such as the speed, weight and design of the vehicles, within, entering and exiting the traffic pattern system are monitored. In block 330, based on the monitored environmental conditions and traffic conditions, the road degradation impact value of a vehicle or vehicles approaching an intersection is determined. In block 340, a permissible impact for traffic prioritization is determined, which may also be based on the environmental conditions and traffic conditions at the intersection. In block 350, if the road degradation impact value of the vehicle or vehicles approaching the intersection exceeds the permissible impact for traffic prioritization, in block 360, the traffic pattern is dynamically adjusted to allow the vehicle or vehicles to pass through the intersection without decelerating. Similarly, additional traffic lights within the traffic pattern system may be prioritized based on the road degradation impact determination.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server.

In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

We claim:

1. A method for prioritizing traffic flow based on vehicle-caused road degradation comprising:

detecting in a traffic control system disposed at an intersection governed by the traffic control system, an approaching vehicle;

classifying the approaching vehicle;

correlating the classification of the approaching vehicle with a road degradation impact resulting from both a deceleration of the approaching vehicle and a subsequent acceleration of the approaching vehicle; and, on condition that the road degradation impact exceeds a permissible impact, transmitting a message to the traffic control system to emit a visual signal permitting the approaching vehicle to pass through the intersection without stopping.

2. The method of claim 1, wherein the road degradation impact is computed based upon both an environmental condition sensed for the intersection and also the classification.

3. The method of claim 1, wherein the road degradation impact is computed based upon both an environmental condition sensed for the intersection and also an axle weight determined for the approaching vehicle based upon the classification.

4. The method of claim 1, wherein the classification of the approaching vehicle is received wirelessly from a broadcasting data source disposed in the approaching vehicle.

5. The method of claim 1, further comprising:

detecting a different vehicle proximate to the intersection and on a roadway that intersects a roadway upon which the approaching vehicle is traveling;

classifying the different vehicle;

correlating the classification of the different vehicle with a different road degradation impact;

comparing the road degradation impact of the approaching vehicle to the different road degradation impact; and, on condition that the road degradation impact of the approaching vehicle exceeds the different road degradation impact, transmitting a message to the traffic control system to emit a visual signal permitting the approaching vehicle to pass through the intersection without stopping while concurrently emitting a visual signal preventing the different vehicle from passing through the intersection.

6. A traffic control system configured for prioritizing traffic flow based on vehicle-caused road degradation, the system comprising:

a host computing system comprising memory and at least one processor;

fixed storage coupled to the host computing system;

one or more sensors in communication with the host computing system; and a traffic flow prioritization module in communication with the host computing system wherein the traffic flow prioritization module comprising computer program instructions executing in the memory of the host computing system that upon execution are adapted to perform:

detecting through the one or more sensors in the traffic control system disposed at an intersection governed by the traffic control system, an approaching vehicle;

classifying the approaching vehicle;

correlating the classification of the approaching vehicle with a road degradation impact resulting from both a deceleration of the approaching vehicle and a subsequent acceleration of the approaching vehicle; and, on condition that the road degradation impact exceeds a permissible impact, transmitting a message to the traffic control system to emit a visual signal permitting the approaching vehicle to pass through the intersection without stopping.

7. The system of claim 6, wherein the road degradation impact is computed based upon both an environmental condition sensed for the intersection and also the classification.

8. The system of claim 6, wherein the road degradation impact is computed based upon both an environmental condition sensed for the intersection and also an axle weight determined for the approaching vehicle based upon the classification.

9. The system of claim 6, wherein the classification of the approaching vehicle is received wirelessly from a broadcasting data source disposed in the approaching vehicle.

10. The system of claim 6, wherein the traffic flow prioritization module further comprises computer program instructions executing in the memory of the host computing system that upon execution are adapted to perform:

detecting a different vehicle proximate to the intersection and on a roadway that intersects a roadway upon which the approaching vehicle is traveling;

classifying the different vehicle;

correlating the classification of the different vehicle with a different road degradation impact;

comparing the road degradation impact of the approaching vehicle to the different road degradation impact; and, on condition that the road degradation impact of the approaching vehicle exceeds the different road degradation impact, transmitting a message to the traffic control system to emit a visual signal permitting the approaching vehicle to pass through the intersection without stopping while concurrently emitting a visual signal preventing the different vehicle from passing through the intersection.

11. A computer program product for prioritizing traffic flow based on vehicle-caused road degradation, the computer program product comprising a computer readable storage medium having program instructions embodied therewith, wherein the computer readable storage medium is not a transitory signal per se, the program instructions executable by a device to cause the device to perform a method comprising:

detecting in a traffic control system disposed at an intersection governed by the traffic control system, an approaching vehicle;

classifying the approaching vehicle;

correlating the classification of the approaching vehicle with a road degradation impact resulting from both a deceleration of the approaching vehicle and a subsequent acceleration of the approaching vehicle; and, on condition that the road degradation impact exceeds a permissible impact, transmitting a message to the traffic control system to emit a visual signal permitting the approaching vehicle to pass through the intersection without stopping.

12. The computer program product of claim 11, wherein the road degradation impact is computed based upon both an environmental condition sensed for the intersection and also the classification.

13. The computer program product of claim 11, wherein the road degradation impact is computed based upon both an environmental condition sensed for the intersection and also an axle weight determined for the approaching vehicle based upon the classification.

14. The computer program product of claim 11, wherein the classification of the approaching vehicle is received wirelessly from a broadcasting data source disposed in the approaching vehicle.

15. The computer program product of claim 11, wherein the method further comprises:

detecting a different vehicle proximate to the intersection and on a roadway that intersects a roadway upon which the approaching vehicle is traveling;

classifying the different vehicle;

correlating the classification of the different vehicle with a different road degradation impact;

comparing the road degradation impact of the approaching vehicle to the different road degradation impact; and, on condition that the road degradation impact of the approaching vehicle exceeds the different road degradation impact, transmitting a message to the traffic control system to emit a visual signal permitting the approaching vehicle to pass through the intersection without stopping while concurrently emitting a visual signal preventing the different vehicle from passing through the intersection.

* * * * *